United States Patent [19]

Schwert

[11] 4,397,726

[45] Aug. 9, 1983

[54] CATHODICALLY PROTECTED VESSEL

[75] Inventor: Joseph A. Schwert, Cary, Ill.

[73] Assignee: A. O. Smith Harvestore Products, Inc., Arlington Heights, Ill.

[21] Appl. No.: 310,498

[22] Filed: Oct. 13, 1981

[51] Int. Cl.[3] ..... C23F 13/00

[52] U.S. Cl. ..... 204/197; 204/148

[58] Field of Search ..... 204/147, 148, 196, 197

[56] References Cited

U.S. PATENT DOCUMENTS

| | | | |
|---|---|---|---|
| 2,459,123 | 1/1949 | Bates et al. | 204/197 |
| 2,729,313 | 1/1956 | Ernestus | 52/266 |
| 2,743,227 | 4/1956 | Waite et al. | 204/197 |
| 2,744,863 | 5/1956 | Andrus | 204/197 |
| 3,012,959 | 12/1961 | Barnard | 204/197 |
| 3,037,925 | 6/1962 | Boncher et al. | 204/197 |
| 3,046,213 | 7/1962 | Bender | 204/197 |
| 3,138,549 | 6/1964 | Adair | 204/197 |
| 3,660,264 | 5/1972 | Schuller | 204/197 |
| 3,715,566 | 2/1973 | Wasson | 219/322 |
| 3,953,311 | 4/1976 | Wasson | 204/197 |
| 4,113,600 | 9/1978 | Cook | 204/197 |

OTHER PUBLICATIONS

"Sacrificial Anodes", (Cathodic Protection Its Theory and Practice in the Prevention of Corrosion) by John H. Morgan, 1960, Macmillan Co., pp. 79–101.

"Finite Element Analysis of Electric Fields Using MSC, Nastran", John R. Brauer, A. O. Smith Corporation, Milwaukee, Wis., Jul. 14, 1978.

*Primary Examiner*—T. Tung

*Attorney, Agent, or Firm*—Andrus, Sceales, Starke & Sawall

[57] ABSTRACT

A cathodically protected storage structure, such as a liquid manure storage tank. The structure comprises a generally cylindrical shell formed of steel plate sections which is mounted on a support or foundation. The steel plate sections are coated with a corrosion resistant material, such as glass, and are bolted together at their overlapping joints. A group of anodes, formed of a metal electropositive to steel, are mounted within the structure, and electrical leads, which are connected to the anodes, pass through bolt holes in the wall of the structure and are connected on the outside of the structure to the metal plate sections. As the anodes are electropositive with respect to the steel plate sections, the anodes will corrode preferentially to thereby protect the steel against corrosion.

8 Claims, 7 Drawing Figures

CATHODICALLY PROTECTED VESSEL

BACKGROUND OF THE INVENTION

Cathodic protection systems are frequently employed to protect steel or ferrous metals from corrosion when exposed to a corrosive media, such as water or other liquids. In the conventional cathodic protection system, a metal which is electropositive to steel, such as zinc or aluminum, is electrically connected to the steel to provide an electrolytic circuit in which the anode will preferentially corrode to thereby prevent corrosion of the steel base material.

Steel vessels are frequently lined with a corrosion resistant material, such as glass or plastic, in an attempt to minimize corrosion of the steel. However, it has been found that intensified corrosion will occur where the steel base is exposed through defects in the coating or in areas where the coating is damaged. Therefore, cathodic protection systems are frequently employed in conjunction with glass lined vessels, such as water heaters, processing vessels, and the like, to prevent the corrosion of any portion of the steel base exposed through defects in the protective coating.

Recently, liquidified manure has been stored in tanks formed of glass coated steel panels. The liquidied manure is highly conductive, approximately ten times as conductive as water, due to the presence of salts from urine and other conductive solids, with the result that rapid concentrated corrosion can occur in areas where the steel is exposed through defects in the glass coating, or in areas where the coating may have been damaged. It has also been found that the glass coating on the edges of the overlapping plate sections is relatively thin as compared to the coating on the flat surfaces, so that the edges can be subject to galvanic attack due to the high conductive nature of the liquified manure.

SUMMARY OF THE INVENTION

The invention is directed to a cathodically protected vessel and has particular application to a structure for cathodically protecting the glass coated steel plates of a liquified manure storage tank.

The storage tank is composed of a plurality of generally curved, glass coated, steel plate sections which are mounted on a concrete foundation or support, and the plate sections are bolted together along their overlapping edges. In one form of the invention, a series of anodes formed of zinc, aluminum or magnesium are mounted on the foundation within the tank and electrical leads, which are connected to the anodes, pass through hollow bolts to the exterior of the tank. The leads are then connected to bolts on the outside of the tank which provide an electrical connection to the metal plate sections.

With this construction, an electrolytic circuit is established and the anodes, being electropositive to steel, will corrode preferentially.

In a modified form of the invention, the anodes are mounted on the wall of the tank adjacent the foundation. In this embodiment, the ends of a core rod project outwardly from the respective ends of each anode, and one end of the core rod is connected in an insulated manner to the tank wall, while the opposite end of the core rod extends in an insulated manner through a bolt hole in the tank wall and is connected through an external electrical lead to the steel plate sections.

The exterior electrical leads provide a convenient mechanism for monitoring the activity of the anodes. By tapping into the leads the operator can determine whether the anode is still active or whether it has been complete dissipitated. The ability to monitor the activity of the anode is a substantial advantage, particularly when dealing with a liquified manure storage tank. With a liquified manure storage tank, the anode would not be visible and there would be no way of determining its stage of activity, unless the tank was drained.

By passing the electrical leads through the existing bolt holes that normally receive bolts to connect the plate sections together, the electrical connection can be made without the necessity of drilling additional holes in the glass coated plate sections.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
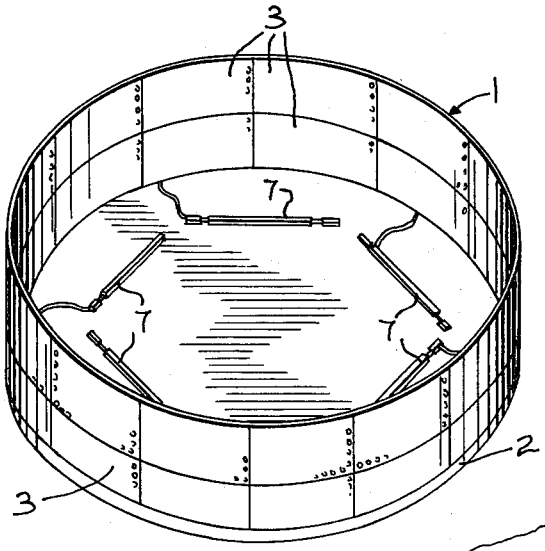
FIG. 1 is a perspective view of a storage tank for liquified manure incorporating the cathodic protection system of the invention.

FIG. 1 illustrates a tank 1 to store liquified manure and which is supported on a concrete base or foundation 2. The tank is formed of a plurality of generally curved steel plate sections 3 which are joined together along their overlapping edges by bolts 4 in a manner set forth in the U.S. Pat. No. 2,729,313. The inner and outer surfaces of the plates are coated with a corrosion resistant material, such as glass or plastic 5.

While the glass or other corrosion resistant coating will tend to protect the steel plate sections from corrosion, it has been found that concentrated corrosion will occur at any portion of the steel which is exposed through defects or damage to the coating. In addition, during the normal glass coating operation, the glass will tend to pull away from the sharp edges of the plate sections during firing of the glass, so that the glass coating will be relatively thin along the edges. It has been the practice in the past to coat the edges of the plate sections with a sealer or mastic material such as shown by 6. Again, any portion of the steel exposed through the mastic 5 would be subject to concentrated corrosion by the highly conductive liquid manure.

Figure 2:
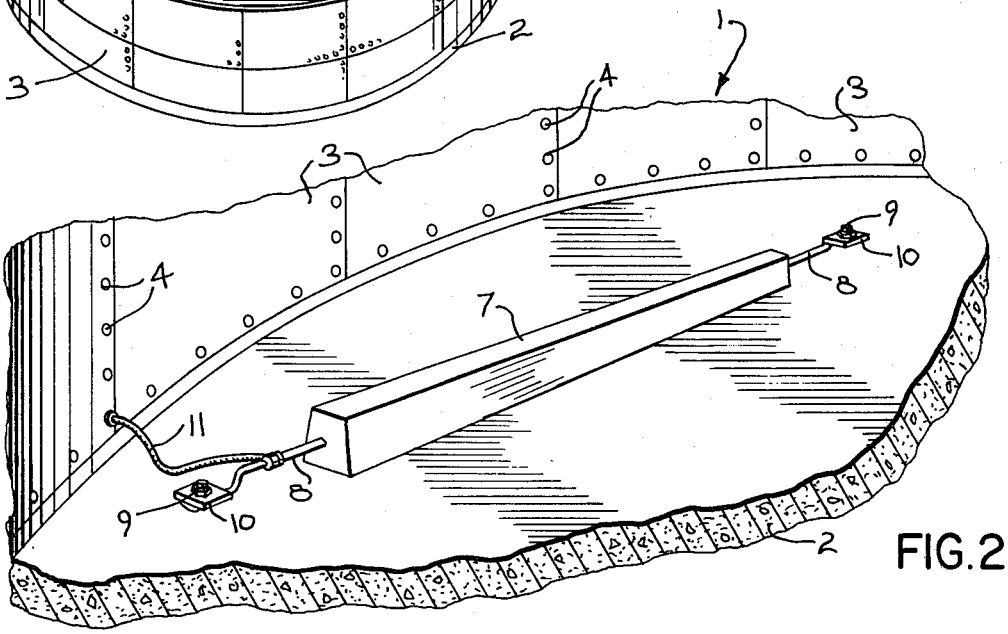
FIG. 2 is an enlarged fragmentary perspective view showing the mounting of an anode on the foundation.

In accordance with the invention, one or more anodes 7 formed of a metal electropositive to steel, such as zinc, aluminum, or magnesium, are mounted on the foundation 2. As best shown in FIG. 2, the anodes 7 are elongated in shape and a core rod 8 is located centrally of each anode.

To mount the anodes 7 to the foundation 2, the outer projecting ends of core rod 8 are secured to the foundation through anchor bolts 9 and washers 10.

Figure 3:
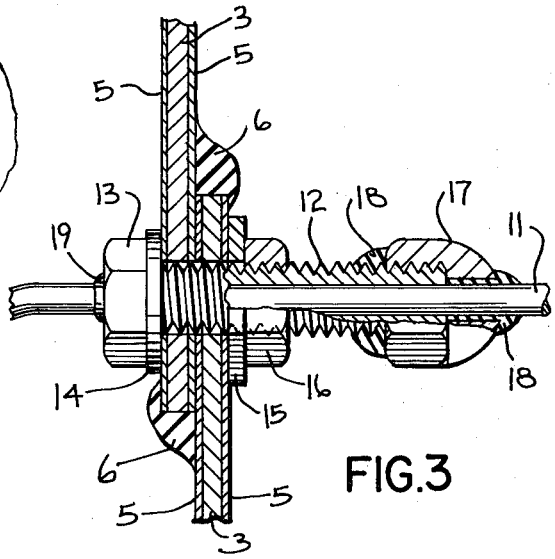
FIG. 3 is a vertical section showing the electrical lead wire connected through the hollow bolt.

One end of each core rod 8 is connected to an insulated lead wire 11, and the wire extends through a hollow bolt 12, similar to bolts 4 which are used to connect the plate sections 3 together. As shown in FIG. 3, the head 13 of the hollow bolt 12 is located on the inside of the tank and a washer 14 is positioned between the bolt head 13 and the glass coated plate section 3. Similarly, a washer 15 and nut 16 are threaded on the outer end of the bolt 12 and bear against the outer surface of the plate section. The outer threaded end of the bolt 12 receives a plastic acorn nut 17, and the acorn nut, prior to being threaded on the bolt, is filled with a sealant or mastic 18. As the acorn nut 17 is threaded down, the mastic 18 will be extruded outwardly to seal the joint between the bolt 12 and the lead wire 11. The lead wire 11 is also sealed within the central opening in the bolt, and this can be readily accomplished by coating the wire 11 with mastic before it is inserted into the hollow bolt which is also filled with mastic. As the wire is inserted into the hollow bolt, the mastic will be extruded to seal the interface between the wire 11 and the bolt hole, as shown by 19.

Figure 4:
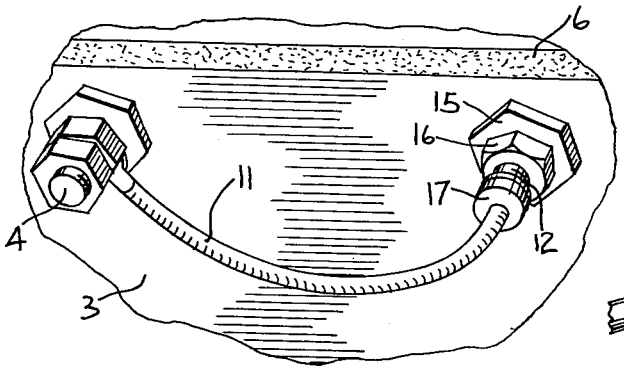
FIG. 4 is a fragmentary perspective view showing the attachment of the electrical lead wire on the outside of the tank.

The outer end of the wire 11 is connected to a bolt 4 on the outside of the vessel, as shown in FIG. 4, and thus will be connected in an electrolytic circuit with the steel plate sections.

As the anodes 6 are electropositive with respect to the steel plate sections 3, the anodes will corrode to protect the steel, thereby substantially improving the overall life of the plate sections.

As the lead wire 11 is exposed on the outside of the tank, the operator can tap into the wire to monitor the activity of each anode 6 and to determine whether the anode has been completely consumed. By passing the lead wire 11 through the hollow bolt 12, the lead wire can be connected on the outside of the tank to the plate sections without the necessity of drilling additional holes in the glass coated plate section. Drilling holes could expose additional areas of the steel base to concentrated corrosive attack by the liquified manure.

Figure 5:
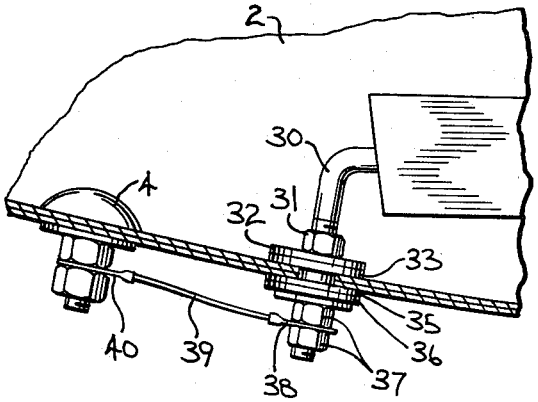
FIG. 5 is a horizontal section showing a modified form the invention in which the anode is attached to the wall of the tank.
Figure 5:
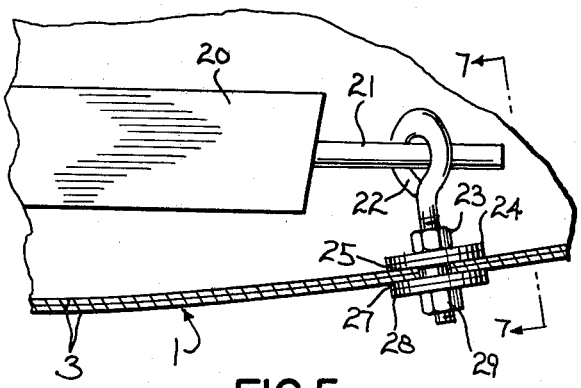
Figure 6:
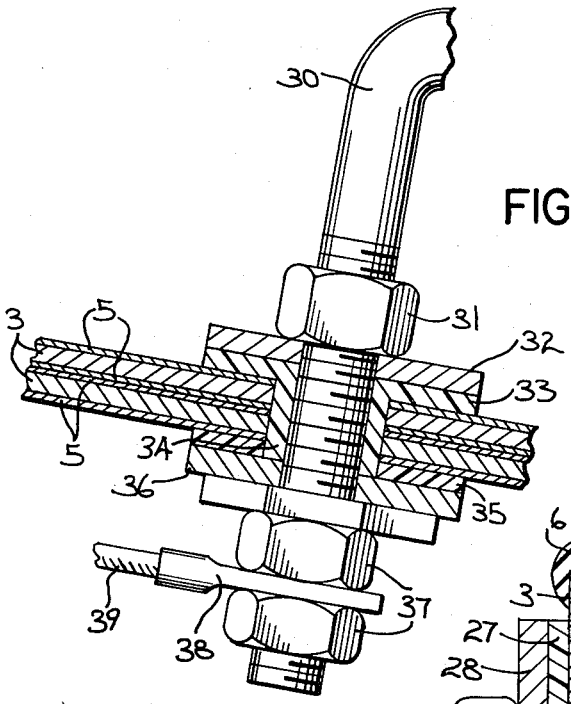
FIG. 6 is an enlarged fragmentary horizontal section showing the electrical connection of the anode to the tank.
Figure 7:
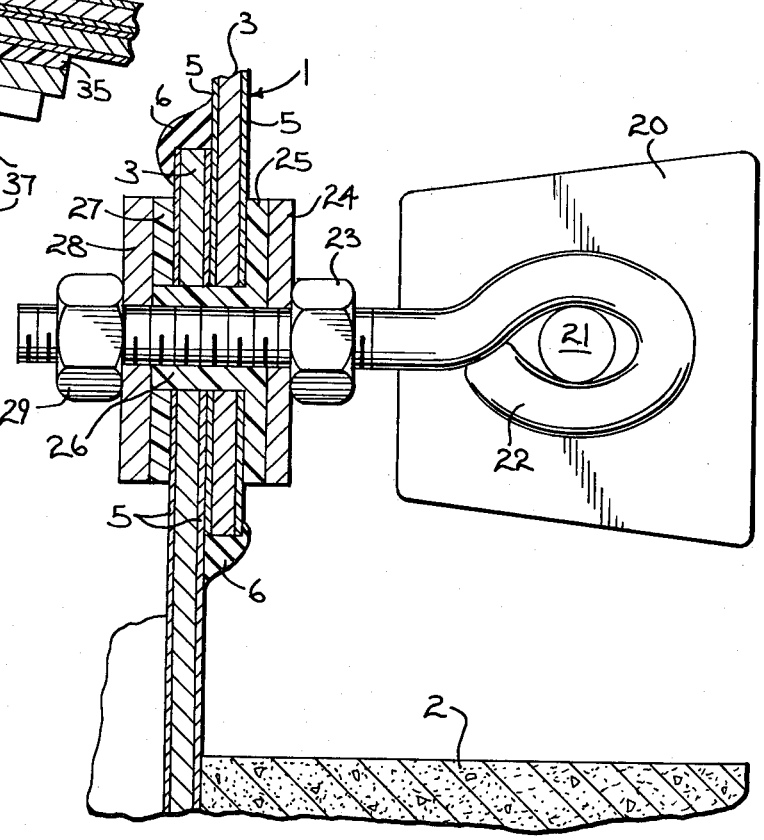
FIG. 7 is a vertical section taken along line 7—7 of FIG. 5.

FIGS. 5–7 show a modified form of the invention in which the anode is attached to the inner wall of the tank 1. In this embodiment, the anode 20, similar in construction to anode 7 of the first embodiment, is provided with a central core rod 21 which projects outwardly from the ends of the anode. One end of the core rod 21 is freely mounted within an eye-bolt 22, and the threaded stem of the eye-bolt projects through aligned bolts holes in the glass coated steel plate sections 3 of the tank. To provide the support through the tank wall, a nut 23 is threaded on the inner portion of the eye-bolt 22 and a metal washer 24 and washer 25 made of plastic or other insulating material, are located outwardly of the nut. The insulating washer 25 is formed integrally with an insulating sleeve 26 which extends through the aligned bolt holes in plate sections 3, and an insulating washer 27 and metal washer 28 are located on the outside of the tank. To complete the assembly, a nut 29 is threaded on the outer end of the eye-bolt. With this construction, the core rod 21 of the anode 20 is attached to the tank in an insulating manner, so that there is no electrical connection between the anode and the metal plate or panels of the tank.

The opposite end of the core rod 21 is bent, as indicated by 30, and extends through aligned bolt holes in the plate sections 3. As in the case of the eye-bolt 22, a nut 31 is threaded on the end 30 and a metal washer 32 and insulating washer 33 with integral sleeve 34 are positioned outwardly of the nut. The sleeve 34 extends through the aligned bolt holes and prevents metal-to-metal contact between the end 30 of the core rod 21 and the steel plate sections 3 of the tank. The outer end of the rod end 30 receives an insulating washer 35, a metal washer 36 and nuts 37.

A terminal connector 38 is mounted on the rod end 30 between the nuts 37 and is connected through an insulated lead wire 39 to a terminal connector 40 on one of the bolts 4 which connect the plate sections of the tank together. Through the lead wire 39, the core rod 21 of the anode is connected to the steel plates of the tank.

As the material contained within the tank, such as manure slurry, is an electrolyte, an electrolytic circuit will be set up through any areas of the steel plates exposed through defects in the corrosion resistant coating. As the anodes are electropositive with respect to the steel plates, the anodes will corrode preferentially to protect the steel plates.

While the drawings show the bent end 30 being integral with the core rod 21, it is contemplated that a separate metal member can be welded or otherwise connected to the straight projecting end of the core rod 21.

Various modes of carrying out the invention are contemplated as being within the scope of the following claims particularly pointing out and distinctly claiming the subject matter which is regarded as the invention.

I claim:

1. A cathodically protected tank assembly, comprising an open top tank to contain an electrically conductive liquid exposed to the atmosphere, said tank including a bottom and a side wall composed of metal components, an anode formed of a metal electropositive to said metal components and disposed adjacent the bottom of said tank, anchoring means for anchoring said anode to said bottom, and connecting means separate from said anchoring means for electrically connecting the anode to said metal components, said connecting means extending in an electrically insulated manner through the wall of said tank to the outside of the tank and being electrically connected on the outside of the tank to said metal components.

2. The tank assembly of claim 1, wherein said metal components comprise a plurality of steel plate sections connected together to form said wall.

3. The tank assembly of claim 2, wherein the adjacent edges of said plate sections are disposed in overlapping relation and the overlapping edges of the plate sections are provided with a series of aligned holes, said connecting means extending in an electrically insulated manner through a pair of said aligned holes to the outside of the tank, and a plurality of fasteners extending through the remaining aligned holes to connect the plate sections together.

4. The tank assembly of claim 1, wherein said anode is elongated and the longitudinal axis of the anode is disposed horizontally.

5. The tank assembly of claim 1, and including a core rod projecting from spaced portions of the anode, one end of said rod being connected to said anchoring means and the opposite end of said rod being connected to said connecting means.

6. A cathodically protected liquid manure tank assembly, comprising an open top tank to contain electrically conductive liquid manure, said tank having a foundation and a side wall composed of a plurality of steel plate sections mounted on the foundation, adjacent edges of the plate sections being disposed in overlapping relation and the overlapping edges of said plate sections being provided with a plurality of aligned pairs of bolt holes, an anode formed of a metal electropositive to steel and disposed wholly within the tank and located adjacent said foundation, anchoring means for anchoring said anode to said foundation, connecting means separate from said anchoring means for electrically connecting said anode to said steel plate sections, said connecting means extending in an electrically insulated manner through a first pair of aligned bolt holes in said plate sections to the outside of the tank and said connecting means being electrically connected on the outside of the tank to said steel plates, and a plurality of bolts extending through the remaining pairs of aligned bolt holes to connect the steel plate sections together.

7. The tank assembly of claim 6, wherein said connecting means includes a rigid metal member connected to the anode and extending through said first pair of aligned bolt holes, and an insulating sleeve disposed around said connecting member and preventing electrical contact between said connecting member and said steel plate sections.

8. The tank assembly of claim 6, including a hollow bolt extending through said first pair of aligned bolt holes, and said connecting means including an insulated electrical lead connected to said anode and extending through said hollow bolt to the exterior of the tank.

* * * * *